US006004006A

United States Patent [19]

Wang

[11] Patent Number: 6,004,006

[45] Date of Patent: Dec. 21, 1999

[54] DECORATIVE LIGHT BULB STAND WITH CLIPPING STRUCTURE

[76] Inventor: Jessica Wang, 4F-3, No. 77, Sec.2, Tun Hwa South Road, Taipei, Taiwan

[21] Appl. No.: 09/244,335

[22] Filed: Feb. 3, 1999

Related U.S. Application Data

[62] Division of application No. 08/975,948, Nov. 21, 1997, Pat. No. 5,893,634.

[51] Int. Cl.[6] ..... F21V 21/00

[52] U.S. Cl. ..... 362/249; 362/396

[58] Field of Search ..... 362/249, 252, 362/396

[56] References Cited

U.S. PATENT DOCUMENTS

| | | | |
|---|---|---|---|
| 2,018,836 | 10/1935 | Clemence | 362/396 |
| 5,428,518 | 6/1995 | Huang | 362/249 |
| 5,531,411 | 7/1996 | Adams | 362/396 |
| 5,595,439 | 1/1997 | Maddock et al. | 362/396 |
| 5,788,362 | 8/1998 | Chou | 362/249 |

*Primary Examiner*—Alan Cariaso

*Attorney, Agent, or Firm*—Pro-Techtor International Services

[57] ABSTRACT

A light bulb stand includes a stand body for connecting a light bulb to electrical wires and a clipping structure attached to the stand body. The clipping structure includes a first clipping portion and a second clipping portion mounted to the stand body to be opposite to each other. The clipping structure includes at least one S-shaped member having two bends connected together to define two ends of which a first end is fixed to the stand body and a second end is free, the bend associated with the first end being arranged to define a spacing with the stand body and the bend associated with the free end being arranged to define a small gap with the stand body.

2 Claims, 5 Drawing Sheets

DECORATIVE LIGHT BULB STAND WITH CLIPPING STRUCTURE

This is a divisional application of applicant's U.S. patent application Ser. No. 08/975,948, filed on Nov. 21, 1997, now U.S. Pat. No. 5,893,634.

BACKGROUND OF THE INVENTION

1. Field of the Invention

The present invention relates generally to a decorative light bulb stand, and more particular to a decorative light bulb stand with clipping structure. The decorative light bulb stand may provide ready fixing of a bulb stands and wires together so that generally consumers may arrange the light string in any desired manner and pattern.

2. Description of the Prior Art

Decorative light strings have been widely used in all kinds of celebration and festival. The decorative light strings comprise electrical wires of a substantial length to which a plurality of the lamp bulbs are connected by means of bulb stands fixed on the wires, preferably in spaced manner.

FIG. 1 of the attached drawings shows an example of the decorative light string which comprises electrical wires 10 on which bulb stands 12 are fixed to each receive and hold therein a bulb 14 that is in electrical connection with the wires 10. A plug 16 and a socket 18 may be provided to the wires 10 for connection with an external power source (not shown) and to provide an electrical connection to another light string. The light string may be attached to any desired article or object, such as a tree, a window or a curtain. The arrangement of the light string on an article may be in any arbitrary pattern by fixing the wires and the bulb stands to the article and to themselves.

An example of the arrangement of the light string is shown in FIG. 2. The decorative light string in this example includes a number of series light strings forming a light curtain. The light curtain includes an electric plug 22, an electric receptacle 24, a first electric power wire L1, a second electric power wire L2, and a number of connecting wires 20. The light bulb stand 100 with clipping structure of the present invention may allow two bulb stands 100 to be held together. In addition, the clipping structure of the bulb stand 100 may serves as a passage to allow the wires 20 extending therethrough and held therein. So, various arrangements may be formed.

The present invention is directed to a decorative light bulb stand with clipping structure to provide ready fixing of the bulb stands and the wires together so that generally consumers may arrange the light string in any desired manner and pattern and may re-arrange the light string readily.

SUMMARY OF THE INVENTION

Therefore, the principal object of the present invention is to provide a light bulb stand comprising a clipping structure mounted thereon to provide a ready-to-form engagement between bulb stands and/or portions of electrical wires.

In accordance with the present invention, a light bulb stand is provided, comprising a stand body for connecting a light bulb to electrical wires and a clipping structure attached to the stand body. The clipping structure is adapted to secure two light structures to each other, and the light structures may include bulb stands and electrical wires. The clipping structure comprises at least one S-shaped member having two bends connected together to define two ends of which a first end is fixed to the stand body and a second end is free, the bend associated with the first end being arranged to define a spacing with the stand body and the bend associated with the free end being arranged to define a small gap with the stand body.

Another object of the present invention is to provide a clipping structure for securing bulb stands and/or electrical wires together.

BRIEF DESCRIPTION OF THE DRAWINGS

The present invention will be described in further detail with reference to the accompanying drawings, wherein.

DETAILED DESCRIPTION OF THE PREFERRED EMBODIMENT

Figure 3:
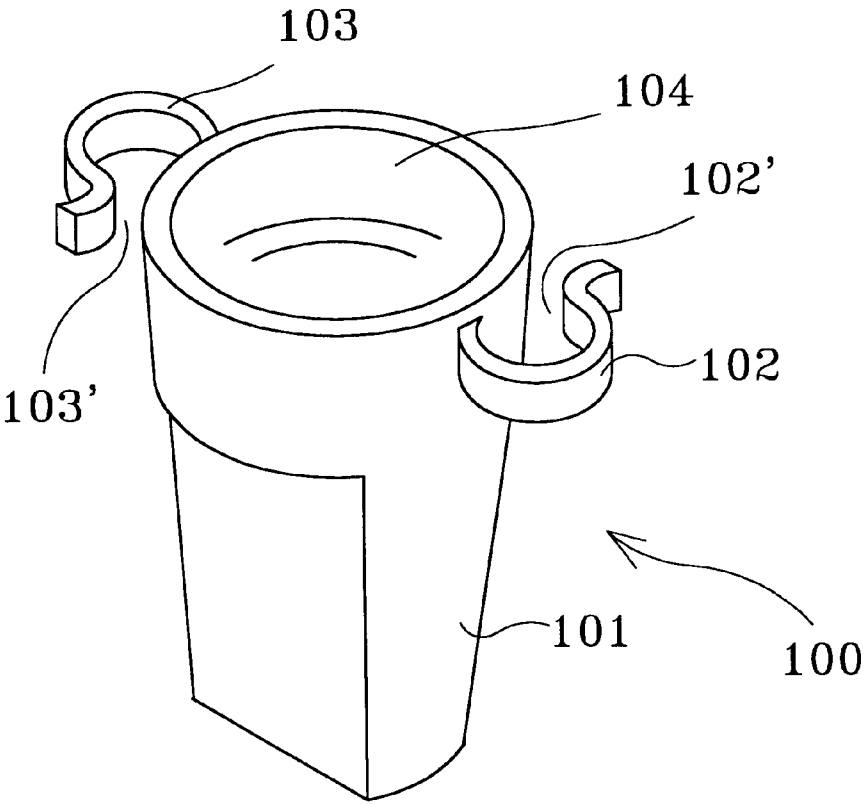
FIG. 3 is a perspective view showing a light bulb stand with clipping structure in accordance with a preferred embodiment of the present invention.

With reference to FIG. 3, wherein a light bulb stand with clipping structure constructed in accordance with the present invention, generally designated with reference numeral 100, is shown. The bulb stand 100 of the present invention comprises a stand body 101 having formed on one end thereof a cavity 104 for receiving therein a bulb (not shown).

The stand body 101 also comprises un-illustrated conductive tabs to which wires (not shown) extending through channels (not shown) formed on the stand body 101 are connected for supply of electricity to the bulb received in the cavity 104 and in electrical engagement with the conductive tabs.

Figure 1:
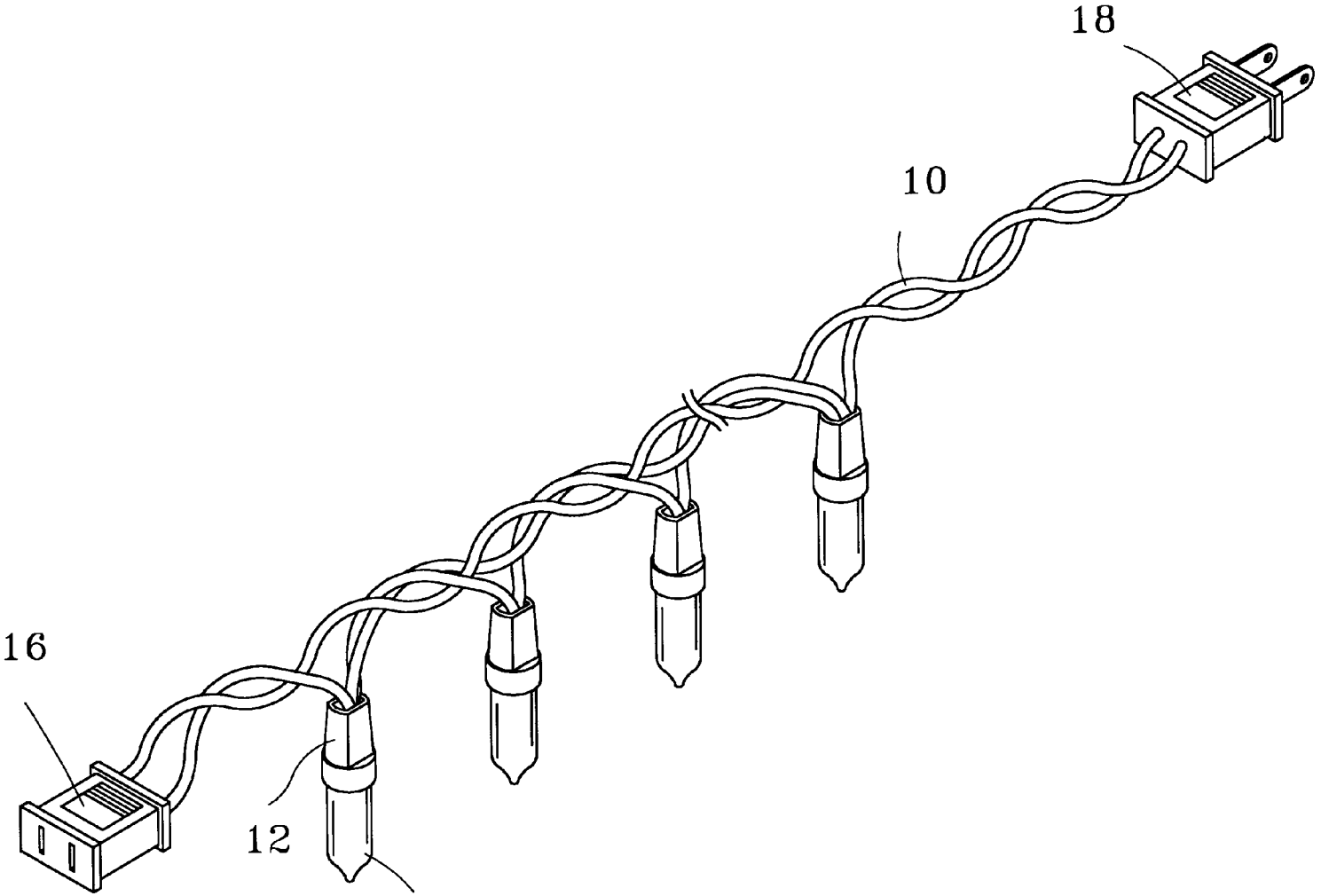
Fig. 1 (PRIOR ART)
FIG. 1 is a perspective view showing a decorative light bulb string which is known.
Figure 2:
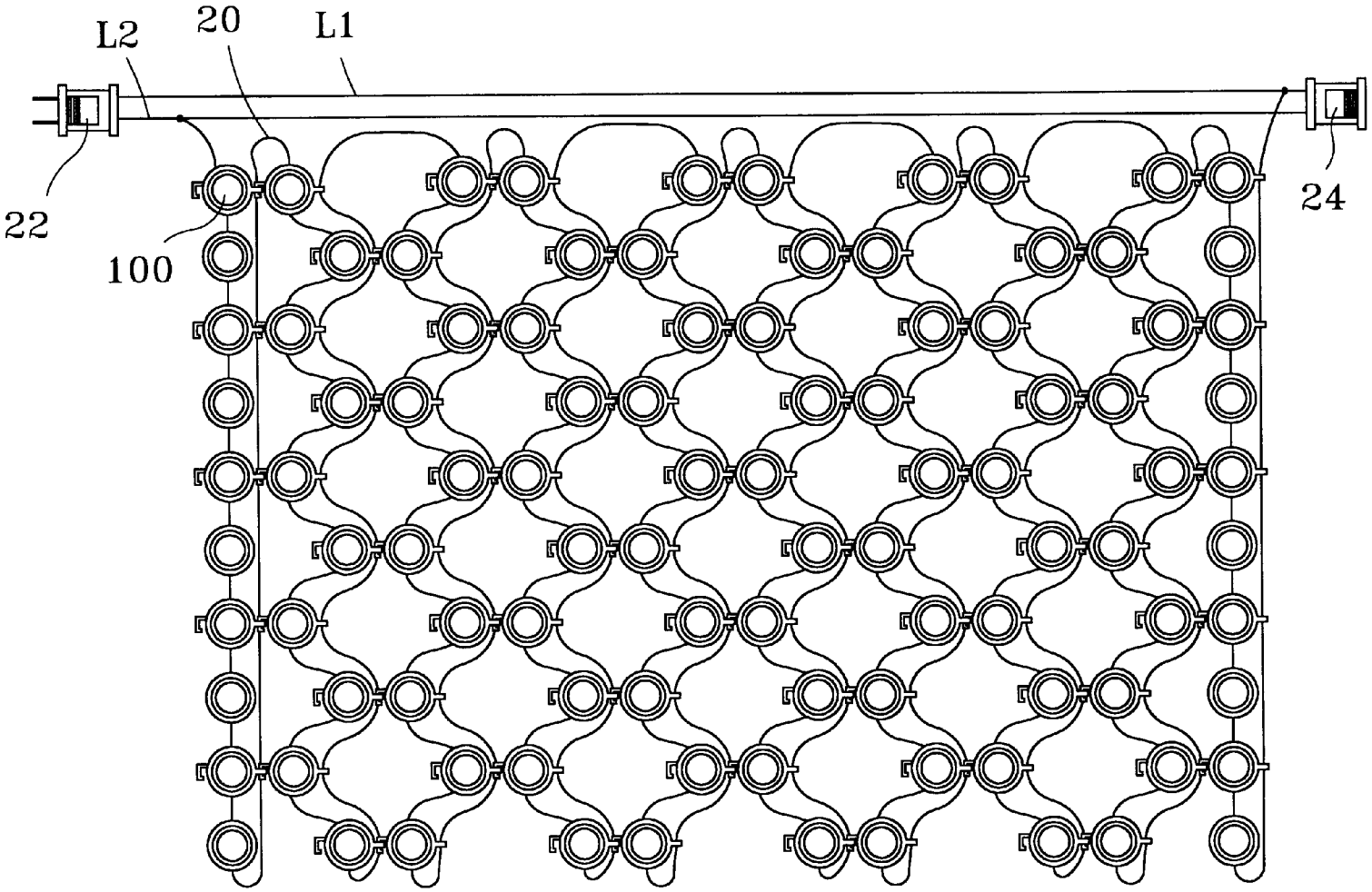
FIG. 2 is a plan view showing a decorative light bulb string pattern formed by using the clipping structure in accordance with the present invention.

As is known to those skilled in the art, conductive tabs (not shown) are provided inside the cavity 104 of the light bulb stand 100 for providing electrical connection with the light bulb. The light bulb stand 100 also comprises wire channels (not shown) extending through the stand body 101, preferably at an end of the stand body 101 opposite to the cavity 104, through which electrical wires 20 (see FIG. 2) extends to electrically connect to the conductive tabs for supply of electricity from for example an external power source to the bulb.

Figure 4:
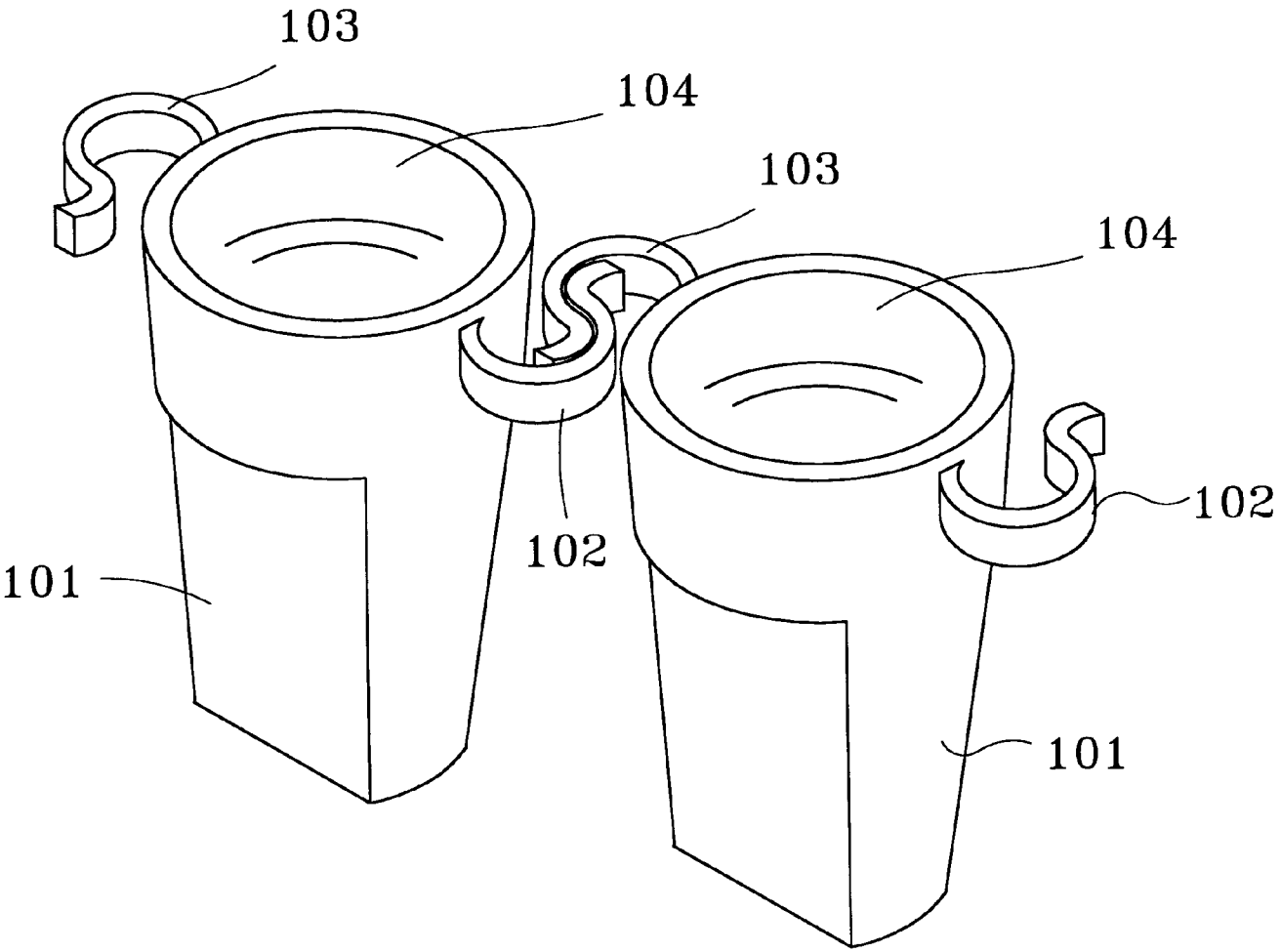
FIG. 4 is a perspective view showing two light bulb stand of the present invention are jointed together.

The bulb stand 100 of the present invention is provided with a clipping structure which includes a first clipping portion 102 and a second clipping portion 103 mounted to two opposite sides of the stand body 101. The first clipping portion 102 and the second clipping portion 103 of the clipping structure in accordance with the preferred embodiment are identical, comprising an S-shaped configuration having two bends and two ends with one end fixed to the stand body 101 in such a way to have one of the bends facing the stand body 101 to form a spacing between the bend and the stand body 101 and another bend facing away from to define a gap 102' or 103' with the stand body 101 which is smaller than the spacing so as to allow the S-shaped first clipping portion 102 of a first bulb stand 100 to be received and held within the S-shaped second clipping portion 103 of a second bulb stand, as shown in FIG. 4.

Figure 5:
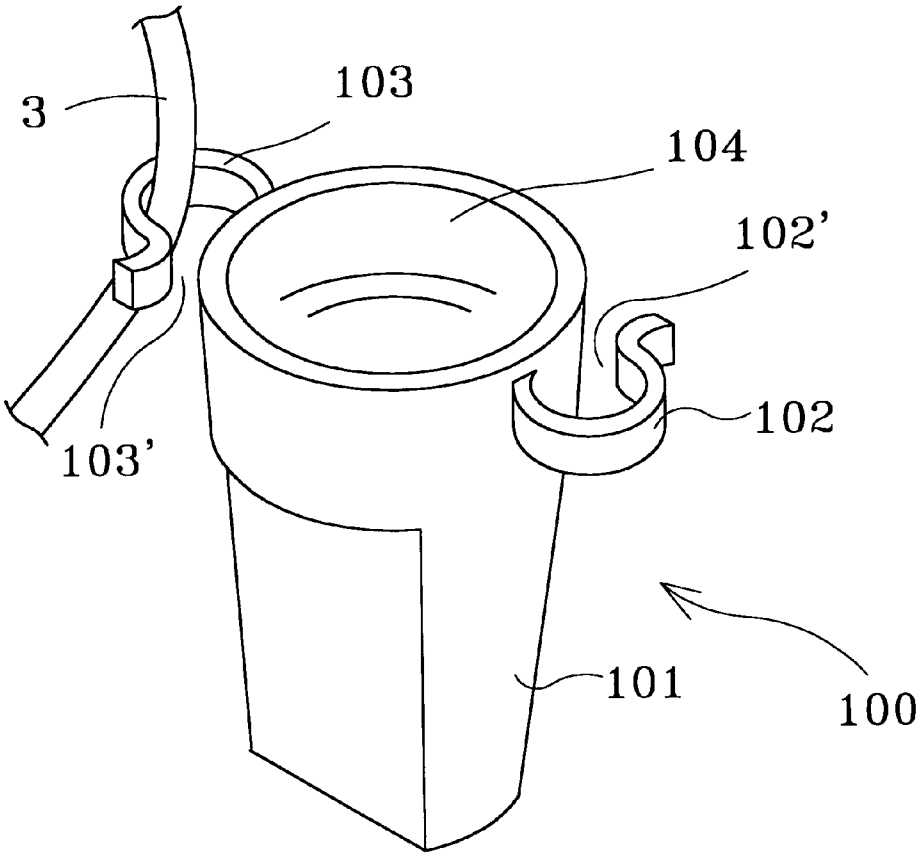
FIG. 5 is a perspective view showing an electric wire is clipped on the light bulb stand of the present invention by a clipping structure formed on the light bulb stand.

Preferably, the first and second clipping portions 102 and 103 are made elastically deformable so as to allow the first clipping portion 102 to be more securely held in the second clipping portion 103 by means of elastic deformation. This provides a ready and easy engagement between two bulb stands. The spacing of either the first clipping portion 102 or the second clipping portion 103 serves as a passage to allow an electric wire 3 or a number of electric wires extending therethrough and held therein, as shown in FIG. 5.

The clipping structure in accordance with the present invention may be integrally formed with the stand body. However, the clipping structure may also be made as a separate member from the stand body.

It is apparent that although the present invention is illustrated with the description of the preferred embodiments thereof, it is contemplated that there may be changes and modifications in the described embodiments that can be carried out without departing from the scope of the invention which is intended to be limited only by the appended claims.

What is claimed is:

1. A light bulb stand set comprising:

at least two light bulb stands, each said light bulb stand comprising a stand body and a clipping structure attached to said stand body, each said clipping structure comprising at least two connecting members affixed opposite each other on a periphery of said stand body, a first one of said connecting members includes an arced portion that curves away from said stand body in a first direction, a second one of said connecting members includes an arced portion that curves away from said stand body in a second direction so that an opening of said first one of said connecting members and an opening of said second one of said connecting members are on opposite sides of a diameter of said stand body; such that an interior portion of said first one of said connecting members is aligned with an interior portion of said second one of said connecting members, and said connecting members of a first one of said light bulb stands receives a connecting member of a second one of said light bulb stands, such that said first and said second light bulb stands are connected in a linear fashion.

2. The light bulb stand as claimed in claim 1, wherein:

each of said arced portions includes a hooked portion at said opening of said arced portion, said hooked portion comprises an arced section that curves in a direction opposite a curvature of said arced portion.

* * * * *